United States Patent [19]

Mimura et al.

[11] Patent Number: 4,960,049

[45] Date of Patent: Oct. 2, 1990

[54] OFFSET PRINTING MACHINE HAVING TWO PRINTING UNITS

[75] Inventors: Takashi Mimura; Nobuhiko Fujisawa, both of Fuchu, Japan

[73] Assignee: Ryobi Ltd., Hiroshima, Japan

[21] Appl. No.: 378,875

[22] Filed: Jul. 12, 1989

[51] Int. Cl.[5] ..... B41F 5/22

[52] U.S. Cl. ..... 101/217; 101/183; 101/232; 101/142

[58] Field of Search ..... 101/76, 183, 184, 185, 101/232, 246, 271, 217, 218, 177, 136, 137, 140, 142, 144, 145

[56] References Cited

U.S. PATENT DOCUMENTS

| | | | |
|---|---|---|---|
| 3,158,092 | 11/1964 | Barthel | 101/137 |
| 3,358,595 | 12/1967 | Lindemann | 101/183 |
| 3,473,468 | 10/1969 | Vandeman et al. | 101/137 |
| 3,785,287 | 1/1974 | Dahlgren | 101/137 |
| 3,835,776 | 9/1974 | Weidman | 101/232 |
| 3,892,178 | 7/1975 | Staamann | 101/177 |
| 4,038,921 | 8/1977 | Harrison | 101/183 |
| 4,111,120 | 9/1978 | Paulson | 101/177 |
| 4,426,929 | 1/1984 | Fujisawa et al. . | |
| 4,449,450 | 5/1984 | Barny et al. | 101/183 |
| 4,530,282 | 7/1985 | Schulz | 101/117 |
| 4,569,284 | 2/1986 | Witczak | 101/183 |
| 4,774,883 | 10/1988 | Mailander | 101/183 |
| 4,854,231 | 8/1989 | Jahn | 101/183 |
| 4,896,599 | 1/1990 | Keller | 101/136 |

*Primary Examiner*—Edgar S. Burr
*Assistant Examiner*—Joseph R. Keating
*Attorney, Agent, or Firm*—Sughrue, Mion, Zinn, Macpeak & Seas

[57] ABSTRACT

An offset printing machine having a first printing unit where an ordinary offset printing is achievable and a second printing unit where a number printing and perforating operations can be performed. The second printing unit has an impression cylinder independent of an impression cylinder of the first unit. The second unit is pivotally movable in horizontal plane with respect to the first unit. When the first and second units are connected to each other, offset printing process and subsequent numbering process are achieved. When the second unit is pivotted and is disconnected from the first unit, ordinary offset printing machine can be solely performed. A chain delivery section is provided in the first unit so as to transfer the printed sheet to the second unit. Tension control means is provided for controlling tension of the chain. Further, vertical and horizontal position fixing means are provided for fixing vertical and horizontal position of the second unit relative to the first unit.

11 Claims, 7 Drawing Sheets

OFFSET PRINTING MACHINE HAVING TWO PRINTING UNITS

BACKGROUND OF THE INVENTION

The present invention relates to an offset printing machine having two printing units independent of each other. More specifically, the invention relates to the offset printing machine having a first printing unit in which an ordinary offset printing is performed and a second printing unit in which a numbering unit provided with an independent impression cylinder is incorporated for number printing operation.

Various conventional offset printing machines have been known where an ordinary offset printing and numbering are achieved. In one conventional offset printing machine, a numbering device is accommodated in an impression cylinder of the printing machine to simultaneously achieve ordinary printing and numbering on the impresion cylinder. That is, the impression cylinder is commonly used for both ordinary printing and numbering operations.

Another conventional offset printing machine has been proposed where a chain delivery section incorporates therein a numbering device, so that an ordinary printing is achieved at an impression cylinder and thereafter, number printing is achieved at the chain delivery section.

In these types of the conventional machines, lateral or transverse perforations or slits cannot be formed at the ordinary printing and the numbering operation, otherwise the main impression cylinder may be damaged. Therefore, after numbering operation, the printed paper must be subjected to perforating operation by a special perforating machine. Therefore, processing period may be prolonged for finally obtaining output print image, numbering image and lateral perforations on the printing paper.

Still another conventional offset printing machine has been proposed in which additional impression cylinder is provided for numbering operation in addition to an impression cylinder for an ordinary printing operation. The two printing sections are communicated with each other by a transfer cylinder. By the provision of the additional impression cylinder, the ordinary printing is carried our independent of the numbering operation, and further, lateral perforations can be formed on the additional impression cylinder simultaneous with the numbering operation. Such conventional machine is disclosed in U.S. Pat. No. 4,426,929 assigned to Ryobi Ltd.

In this type of the machine, the printing sheet is depressed against the additional impression cylinder during the numbering operation, perforating operation and a resin relief printing operation, and therefore, the printed paper can be curved in conformance with the outer peripheral curvature of the impression cylinder. However, if such operations are not carried out, a tail edge portion of the printed paper may be separated from the cylinder surface due to warp of the paper. If such floating paper may be travelled with contacting ambient mechanical components, the printing area may be scratched by the ambient compenent to degrade printing quality. Such tendency becomes often acknowledgeable in case of the employment of a thick paper or a paper having linear orienting characteristics because of its high elasticity.

SUMMARY OF THE INVENTION

It is therefore, an object of the present invention to overcome the above-mentioned prior art disadvantages and to provide an improved offset printing machine having two printing units.

Another object of the invention is to provide such printing machine in which a second printing unit can be connected to and disconnected from a first printing unit, so that the first printing unit can be solely operated with avoiding above described drawbacks occurred in the second printing unit which is provided with an independent impression cylinder.

Still another object of the invention is to provide the printing machine capable of performing inherent printing operation of the first printing unit.

Still another object of the invention is to provide the printing machine in which ordinary driving modes for driving the first and second printing units can be maintained without any change of gear meshing manner in a power transmission system despite the fact that the first and second printing units are seletively connected with each other.

These and other objects of the present invention will be attained by providing an offset printing machine having two printing units comprising: a first printing unit comprising a front frame, a rear frame, a first impression cylinder, and a first chain delivery unit having an endless chain and a driven shaft rotatably supported by the front and rear frames, a second printing unit comprising a second front frame, a second rear frame, and a second impression cylinder, a tension control means for controlling tension of the endless chain, the tension control means comprising a pair of first and second bearing holders for supporting the driven shaft and movable relative to the front and rear frames in a tension controlling direction; a linking holder provided integral with the first bearing holder and a pivot holder provided integral with the second bearing holder, means for pivotting the second printing unit, the pivotting means comprising the pivot holder, a first holder fixed to the second rear frame, a pivot bolt supported on the first holder and engageable with the pivot holder, and means for connecting the second unit to the first unit, the connecting means comprising the linking holder, a second holder fixed to the second front frame, and a linking pin supported by the second holder and engageable with the linking holder.

In one embodiment of this invention, there are further provided a horizontal position fixing means and a vertical position fixing means. The horizontal position fixing means is adapted for fixing a horizontal position of the second printing unit relative to the first printing unit, the horizontal position fixing means being disposed between the first and second printing units and detachably coupling the second printing unit to the first printing unit. The vertical position fixing means is adapted for fixing a vertical position of the second printing unit relative to the first printing unit, the vertical position fixing means being disposed between the first and second printing units.

When the vertical and horizontal position fixing means are released and the linking pin is disengaged from the linking holder, the second printing unit can be pivotally moved about the pivot volt in a first direction. Therefore, the second unit can be separated or disconnected from the first unit. By this separation, only the first printing unit can be operated for ordinary offset printing operation. Therefore, the printed sheet can be discharged on a discharge tray accommodated in the first unit. This tray can be easly removed therefrom because of the provision of an open space, since the second printing unit is largely displaced from the first unit.

If the second printing unit is pivotally moved to a direction opposite the first direction, the second unit can be connected to the first unit by engaging the linking pin with the linking holder. In this case, the vertical and horizontal position fixing means provide fixed vertical and horizontal positions of the second unit relative to the first unit. Therefore, the second unit can be promptly operated without any fine positional adjustment.

Further, even though the tension control means may displace an axis of the driven shaft, no spacial or positional relationship is changed between the chain delivery unit and the second impression cylinder, since the first bearing holder and the linking holder are integrally provided end the second bearing holder and the pivot holder are also integrally provided. These holders are movable together with the movement of the driven shaft. In other words, horizontal position fixing position and the vertical position fixing position are also changed in accordance with the positional change of the driven shaft. As a result, the printed sheet can be smoothly transferred to the second impression cylinder, and the second impression cylinder can be regularly driven.

DETAILED DESCRIPTION OF THE PREFERRED EMBODIMENT

An offset printing machine having two printing units according to one embodiment of this invention will be described with reference to drawings.

Figure 1:
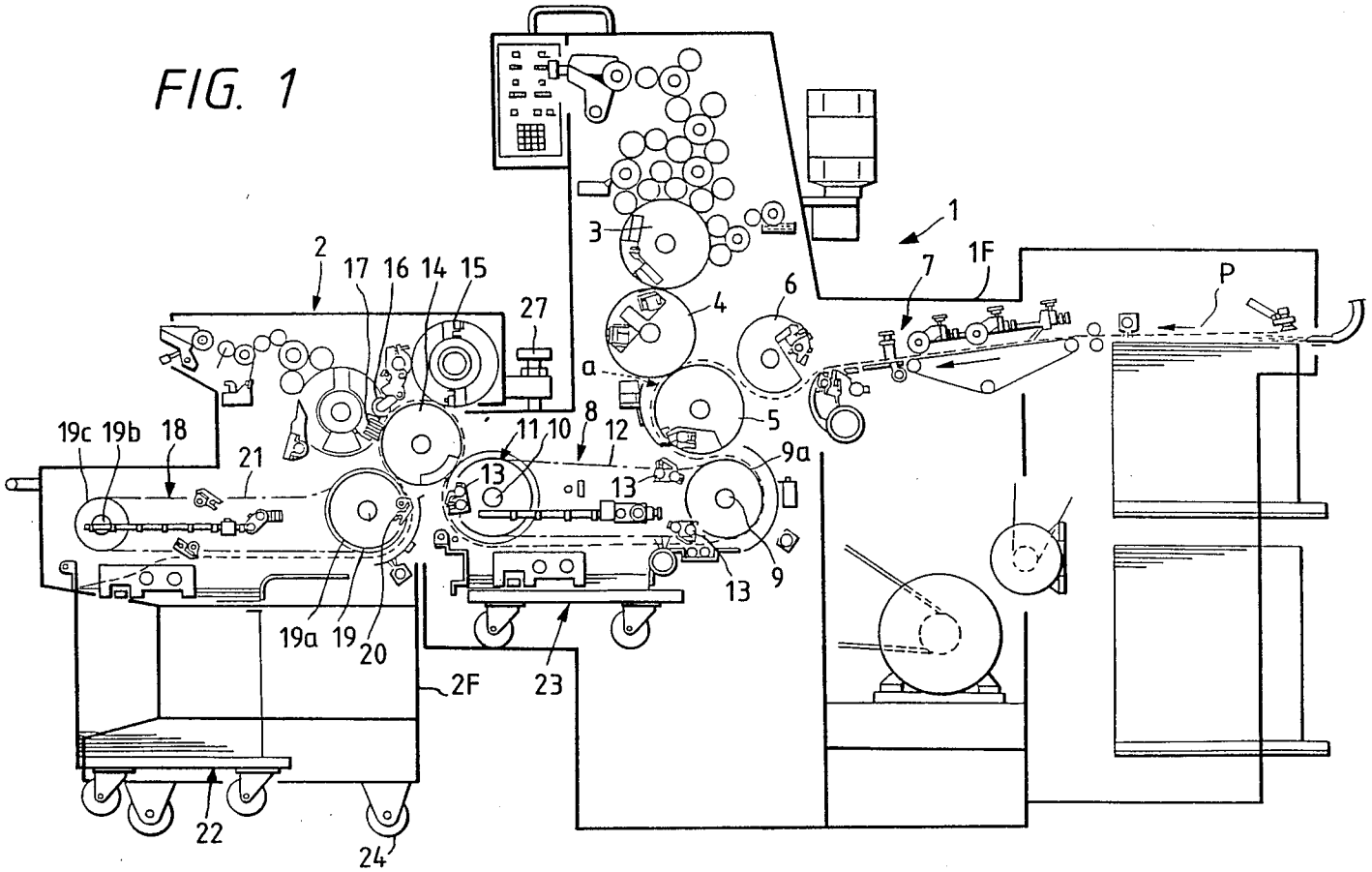
FIG. 1 is a schematic side elevational view showing an offset printing machine having two printing units according to one embodiment of this invention, where the two printing units are connected with each other.

Referring first to FIG. 1, a first printing unit 1 where an ordinary offset printing is performed and a second printing unit where numbering operation is performed are connected to each other. The first printing unit 1 includes a plate cylinder 3, a blanket cylinder 4, an impression cylinder 5, a sheet feed cylinder 6, a sheet feeding section 7 and sheet discharge section 8. The sheet discharge section 8 includes a sprocket 9*a* of a drive shaft 9, a sprocket 11 mounted on a driven shaft 10 and an endless chain 12 mounted on the sprockets 9*a* and 11. The endless chain 12 is provided with grippers 13. A sheet discharge tray 23 is positioned below the sheet discharge section 8.

The second printing unit 2 includes a second impression cylinder 14, a lateral perforating means 15, a vertical perforating means 16, a numbering device 17, a second sheet discharge section 18 and a second sheet discharge tray 22. The second sheet discharge section 18 includes a second drive shaft 19 provided with a sprocket 19*a*, a driven shaft 19*b* provided with a sprocket 19*c*, and an endless chain 21 mounted over the sprockets 19*a* and 19*c*. The endless chain 21 is provided with grippers 20. Components of the second printing unit 2 are accommodated in a frame 2F which is movable relative to the stationary first printing unit 1 by providing casters 24.

In a state where the first and second printing units 1 and 2 are connected together as shown in FIG. 1, a sheet P printed at a position between the blanket cylinder 4 and the impression cylinder 5 is gripped by the gripper 13, and is transferred to the second impression cylinder 14 by way of the sprocket 11. On the second impression cylinder 14, the sheet P is subjected to lateral and vertical perforating operations and numbering operation, and is then delivered to the chain delievery unit 21, where the gripper 20 grips the sheet P. The sheet P is transferred along the chain delivery unit 21 and is discharged onto the second discharge tary 22.

When the second printing unit 2 is separated from the first printing unit 1 (described later in detail), that is when the second printing unit 2 is not operated, the sheet P gripped by the gripper 13 is transferred along the chain 12, and is discharged onto the discharge tray 23.

Figure 2:
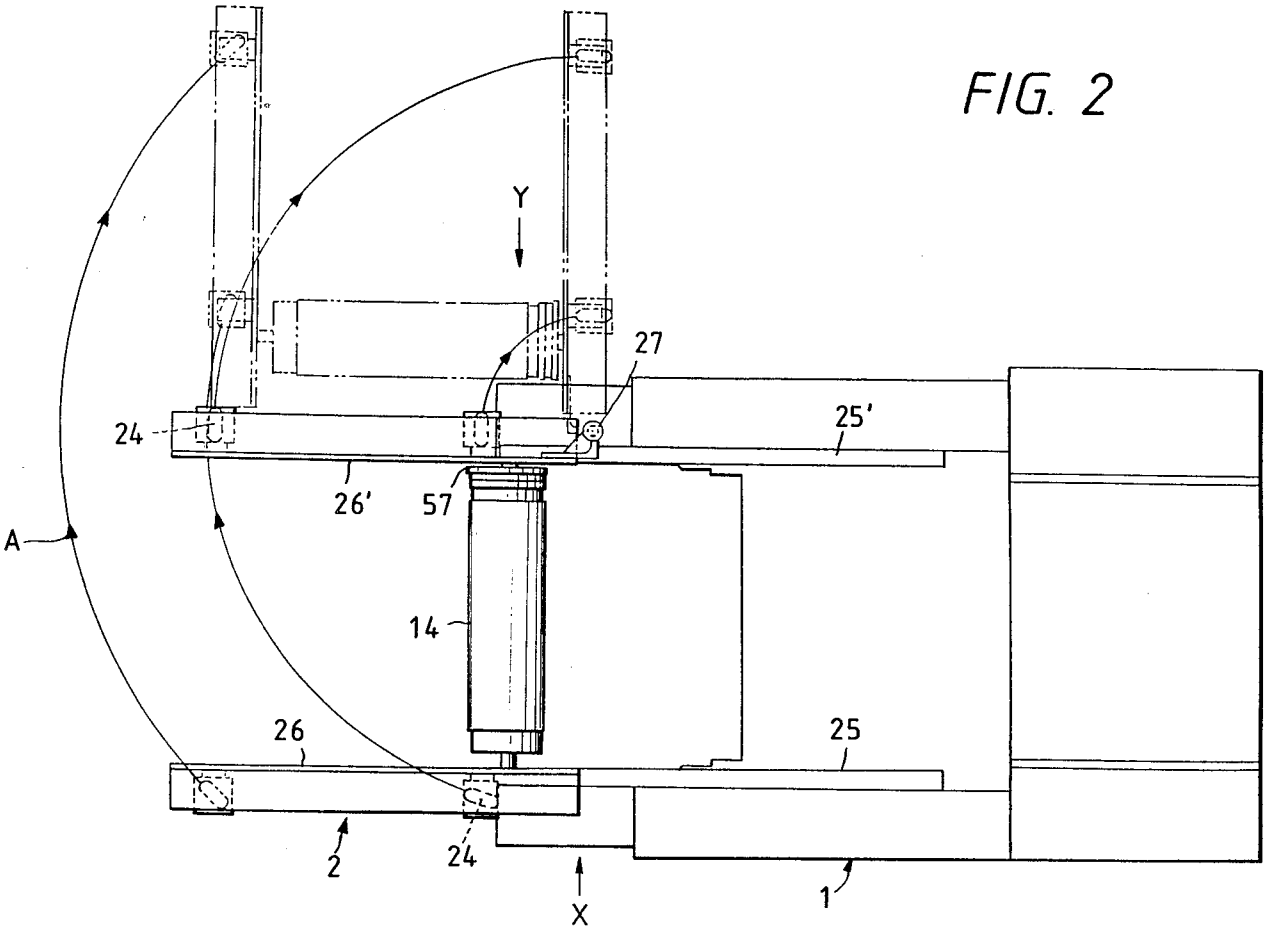
FIG. 2 is a plan view showing connection and disconnection states between the two printing units according to the embodiment of this invention.

As shown by a solid line in FIG. 2, the second printing section 2 is connected to the first printing section for number printing operation subsequent to the ordinary image printing operation, and as shown by two dotted chain line in FIG. 2, the second printing section 2 is disconnected from the first section 1 for exclusively performing the ordinary image printing operation at the section 1. The first printing unit 1 has a frame 1F which includes an operator's side frame 25 and non-operator's side frame 25'. Further, the frame 2F of the second unit 2 includes an operator's side frame 26 and non-operator's side frame 26'. The frames 25' and 26' are connected to each other by a pivot bolt 27, so that the second unit 2 is pivotally movable in a horizontal plane about the pivot bolt 27 in a direction away from the operator's side as indicated by an arrow in FIG. 2. Therefore, when the second unit 2 is separated from the first unit 1, the first dischage tray 23 of the first unit 1 can easily be taken out of and inserted into the frame 1F.

Figure 3:
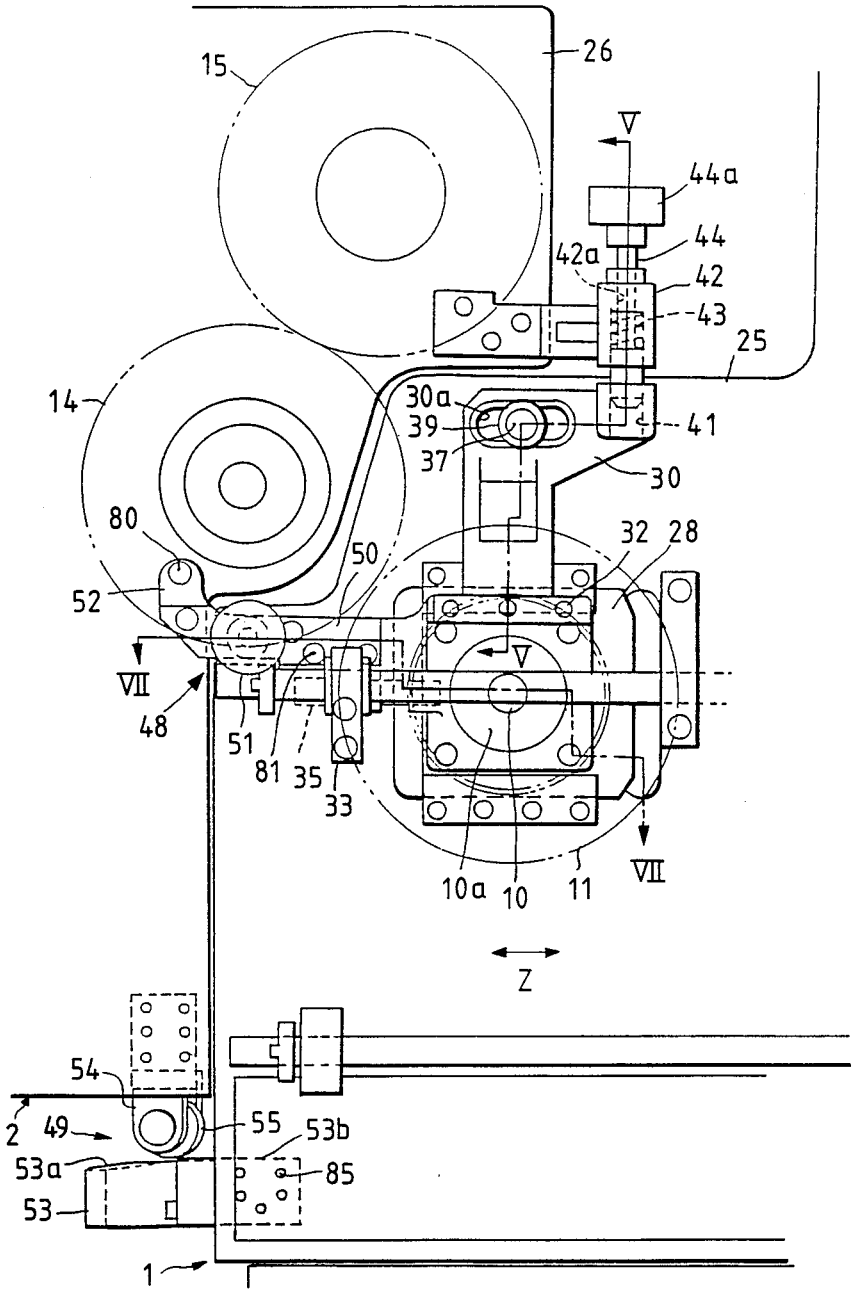
FIG. 3 is a side view as viewed from an operator's side showing essential juncture portion between first and second printing units in the embodiment.
Figure 4:
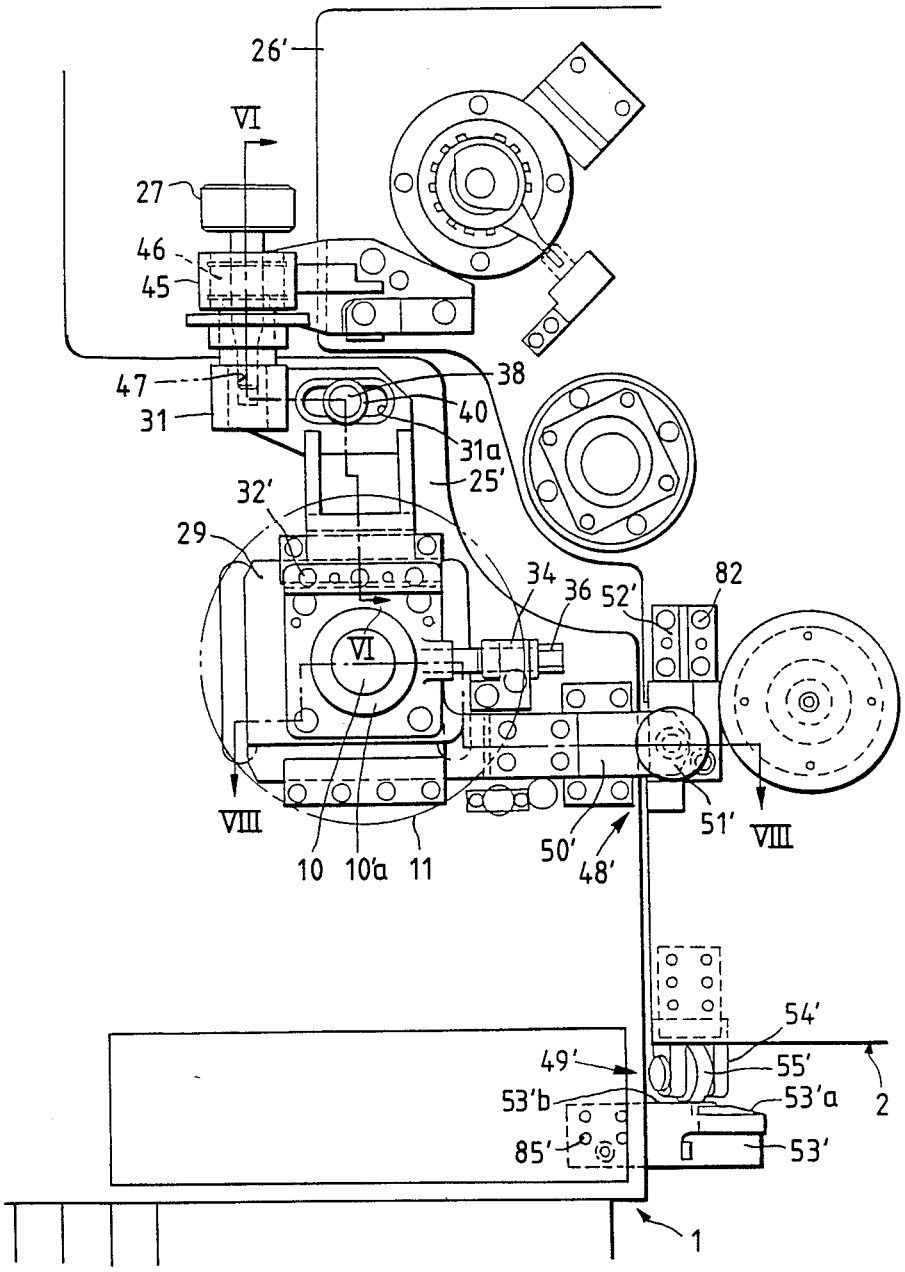
FIG. 4 is a side view as viewed from a non operator's side showing essential juncture portion between the first and second printing units in the embodiment.

A juncture portion between the first and second printing units 1 and 2 is shown in FIGS. 3 and 4 which are side views as viewed from an operator's side and non operator's side in directions indicated by arrows X and Y, respectively, in FIG. 2, and cross sectional views are shown in FIGS. 5 thru 8. In these drawings, a tension control means is provided for control tension of the endless chain 12 of the first printing unit 1.

Chain tension control means

Figure 5:
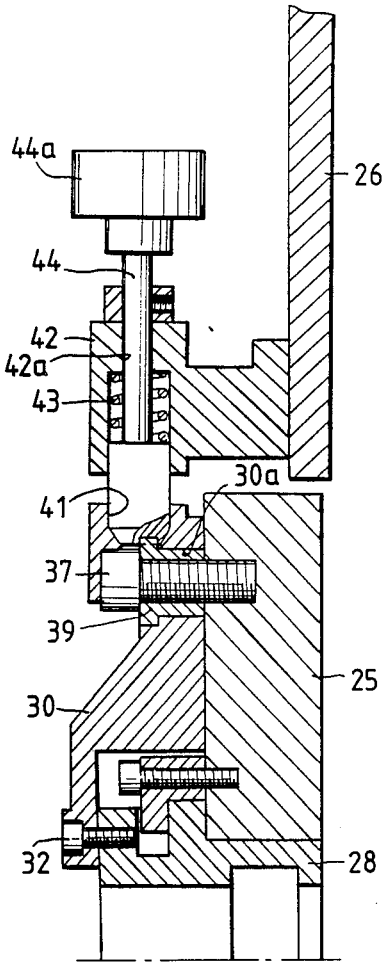
FIG. 5 is a cross-sectional view taken along a line V—V of FIG. 3.
Figure 6:
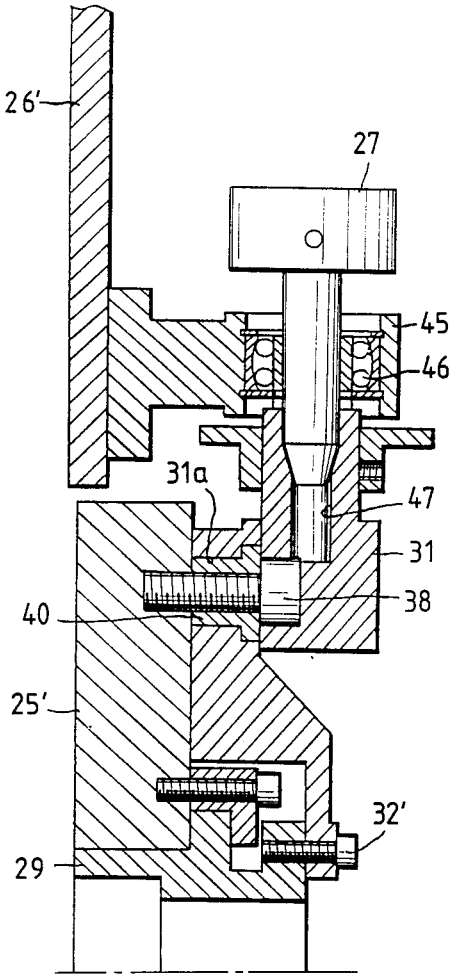
FIG. 6 is a cross-sectional view taken along a line VI—VI of FIG. 4.

The driven shaft is rotatably supported by side frames 25 and 25' through bearings 10*a* 10*a'* which are supported by bearing holders 28 29 fitted with the frames 25 25'. As best shown in FIGS. 5 and 6, a linking holder 30 is fixed to the bearing holder 28 by bolts 32, and a pivot holder 31 is fixed to the bearing holder 29 by bolts 32'. The frames 25 and 25' are provided with blocks 33 and 34, respectively. The block 33 supports a bolt 35 threadingly engageable with the bearing holder 28, and the block 34 supports a bolt 36 threadingly engageable with the bearing holder 29. Upon rotation of the bolts 35 36 about their axes, the bearing holders 28 and 29 are movable in a direction indicated by an arrow Z, so that tension applied to the endless chain 12 is controllable.

Elongated slots 30*a* and 31*a* are formed at the linking holder 30 and the pivot holder 31. These slots 30*a* and 31*a* extend in direction parallel with the longitudinal direction of the endless chain 12 (tension control direction). Screws 37 and 38 extend through the slots 30*a* 31*a* and are threadingly engaged with the frames 25 25', respectively. Further, hollow spacers 39 and 40 are rotatably disposed over the screws 37 38 and extend through the slots. Upon rotating the bolts 35 36, the bearing holders 28 and 29 are moved in the direction Z, so that the linking holder 30 and the pivot holder 31 are also moved in the direction Z. The engagements between the spacers 39 40 and the slots 30*a* 31*a* guide travel of the bearing holders.

Detachable connection between the first and second units (a) Operator's side

As shown in FIGS. 3 and 5, the linking holder 30 has an upper end portion formed with a linking hole 41 extending in vertical direction. On the other hand, a holder 42 is fixedly secured to the frame 26 of the second printing unit 2. The holder 42 is formed with a through hole 42*a* extending in vertical direction in which a connecting pin 44 having a pin head 44*a* is slidably disposed. Further, a spring 43 is disposed over the pin 44 so as to urge the latter downwardly. Therefore, the pin 44 biasedly extends into the linking hole 41, whereby the second unit 2 is linked to the first unit 1 in a manner shown in FIG. 1. If the second unit 2 is intended to be separated from the first unit 1, the pin head 44*a* is pulled upwardly against the biasing force of the spring 43, so that the pin 44 can be disengaged from the linking hole 41.

(b) Non-operator's side

As shown in FIGS. 4 and 6, the pivot holder 31 has an upper portion formed with a thread hole 47 extending in vertical direction. Further, a holder 45 is fixedly secured to a frame 26' of the second printing unit 2. In the holder 45, an automatic centering bearing 46 is assembled, and the above described pivot bolt 27 is rotatably supported by the bearing 46. The pivot bolt 27 is formed with a female thread engageable with the thread hole 47 of the pivot holder 31. With this structure, the frame 26' of the second unit 2 is provided pivotable relative to the frame 25' by way of the pivot bolt 27. That is, as best shown in FIG. 2, the second unit 2 is moved to an inoperative position as shown by the two dotted chain line, where the unit 2 is separated from the first unit 1, and the pin 44 is disengaged from the linking hole 41. When the second unit 2 is swung back about the pivot bolt 27 as shown by the solid line in FIG. 2, the pin 44 is engaged with the linking hole 41. Further, the pivot bolt 27 can be completely disengaged from the thread hole 47 of the pivot holder 31, if the complete separation of the second unit 2 from the first unit 1 is intended.

Horizontal position fixing means

Horizontal position fixing means 48,48' are provided at both operator's side and non-operator's side for fixing horizontal position of the second printing unit 2 relative to the first printing unit when these are connected together.

(a) Operator's side

Figure 7:
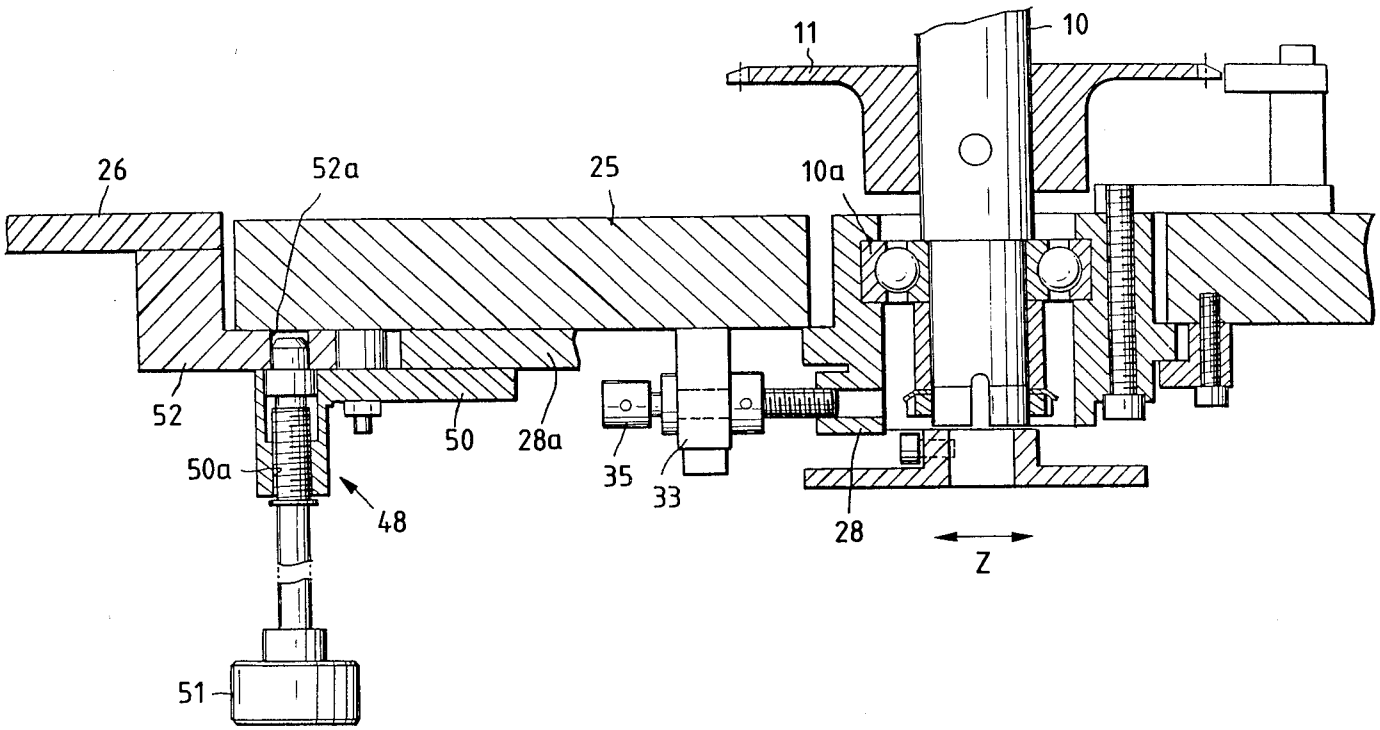
FIG. 7 is a cross-sectional view taken along a line VII—VII of FIG. 3.

As shown in FIGS. 3 and 7, the bearing holder 28 has a horizontally extending member 28*a* to which a pin holder 50 is secured by bolts 81. The pin holder 50 is formed with a thread hole 50*a* with which a positioning pin 51 is engaged. On the other hand, a holder 52 is fixedly secured to the frame 26 of the second unit 2 by bolts 80, and a hole 52*a* are formed in the holder 52. The positioning pin 51 can extend into the hole 52*a* so that the horizontal position of the second unit 2 relative to the first unit 1 can be defined.

(b) Non-operator's side

Figure 8:
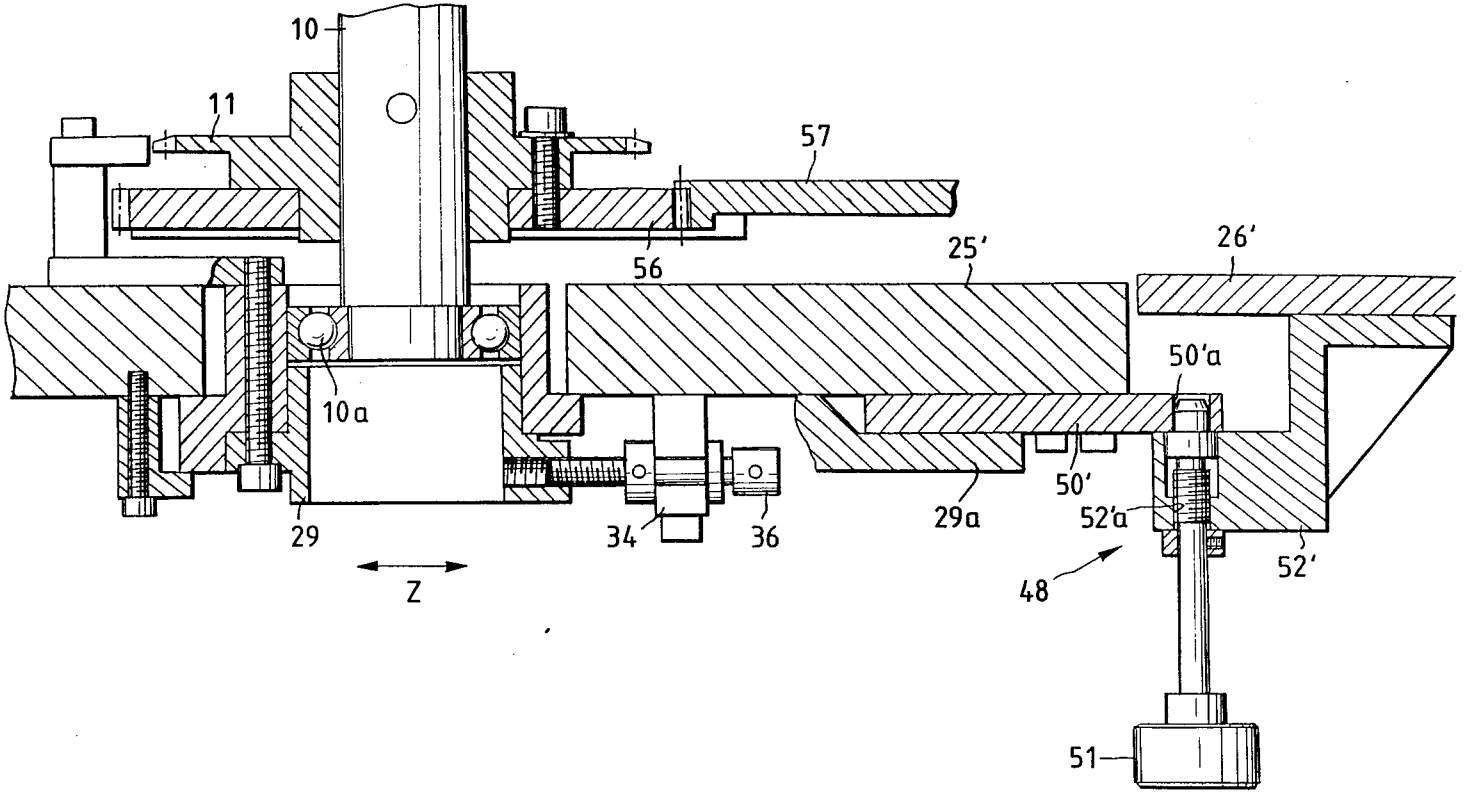
FIG. 8 is a cross-sectional view taken along a line VIII—VIII of FIG. 4.

As shown in FIGS. 4 and 8, the bearing holder 29 has a horizontally extending member 29*a* to which a holder 50' is fixed. The holder 50' is formed with a hole 50*a*'. On the other hand, a holder 52' is fixedly secured to the frame 26' by bolts 82. The holder 52' is formed with a thread hole 52*a*' with which a positioning pin 51' is engaged. A tip end of the pin 51' extends into the hole 50*a*', so that the horizontal position of the second unit 2 relative to the first unit 1 is defined.

Vertical position fixing means

Vertical position fixing means 49 49' are provided at both operator's side and non-operator's side for fixing vertical position of the second printing unit 2 relative to the first printing unit 1 when these are connected together. The vertical position fixing means 49 and 49' are identical with each other at both operator's side and non-operator's side. As shown in FIGS. 3 and 4, holders 53 53' horizontally extend from lower positions of the frames 25 25' toward frames 26 26' of the second unit 2. These holders are fixedly secured to the frames 25 25' by bolts 85 85'. Each of the holders 53 53' has an upper face whose front end is downwardly slanted to form a slant surface 53*a* and 53*a*', which is contiguous with the a rear horizontal face 53*b* and 53*b*'. On the other hand, the frames 26 26' have lower end portions fixedly provided with holders 54 54' extending downwardly. The holders 54 54' rotatably support wheels 55 55'.

When the second printing unit 2 is pivotally moved toward the first unit 1 in a direction opposite the arrow A, the wheels 55 55' initially ride over the slanting surfaces 53*a* 53*a*', and then at the final pivotal moving phase of the second unit 2 the wheels 55 55' ride over the horizontal faces 53*b* 53*b*'. Therefore, vertical position of the second unit 2 can be defined upon connection of the second unit 2 to the first unit 1.

Power transmission

As shown in FIG. 8, the driven shaft 10 integrally secures the sprocket 11. Further, a gear 56 is fixed to the sprocket 11, so that the gear 56 is rotatable together with the rotation of the shaft 11. The gear 56 is meshedly engageable with a gear 57 of the additional impression cylinder 14. Therefore, when the second unit 2 is connected to the first unit 1, a driving power in the first unit 1 can be transmitted to the second impression cylinder 14 through the sprocket 11, the gear 66 and the gear 57. In this case, the positional relationship between the gear 56 and the gear 57 can be maintained unchanged in spite of the position changeable arrangement of the shaft 10, since the linking holder 30, tho pivot holder 31, and other holders for position fixing means 48 48' are also moved together with the shaft 10 (the positions of the bolts 27, pin 44 pins 51 51' are also changed with respect to the first printing unit 1 in accordance with the positional change of the shaft 10). Therefore, these gears 56 and 57 can be engaged with each other at optimum meshing condition to thereby ensure operation in the second printing unit 2. Such spacial relationship can also provide uniform distance between the second impression cylinder 14 and the driven shaft 10 in spite of the tension control to the endless chain 12 by moving the position of the shaft 10. Therefore, printing sheet P can be regularly transferred from the gripper 13 to the second impression cylinder 14 without any deviation.

In the above described embodiment, the second printing unit 2 performs number printing operation by the operation of the numbering device 17. However, the second unit 2 can be used as a vertical perforating unit or resin relief printing unit because of the independent provision of the second impression cylinder 14.

In view of the foregoing, according to the present invention, since the second printing unit 2 can be selectively disconnected from the first printing unit 1, desirable image is obtainable at the first printing unit 1, singe the impression cylinder in tho first unit is not used as a back-up cylinder for perforating operation, but can be exclusively used as the impression cylinder for the image output. Further, the second printing unit 2 can be exclusively used for numbering as well as for perforating operations. Therefore, high operability is obtainable, and number printing operation can be carried out with accurate sheet aligning position relative to the second impression cylinder.

Since the second printing unit 2 can be disconnected from the first unit 1, if only an image recordation is intended on the sheet P, only the first unit 1 can be operated. Therefore, the image carrying sheet P is discharged onto the first discharge tray 23 without being further transferred through the second printing unit 2. Accordingly, high quality image can be produced on the sheet P since output image on the sheet P is not damaged by ambient mechanical components in the second unit 2.

Further, the linking holder 30 and the pivot holder 31 are movable together with the movement of the driven shaft 10 since these are connected to the bearing holders 28 29 which support the shaft 10. Therefore, even if the shaft position 10 is changed in accordance with the tension control to the chain 12, and even if the second unit 2 is movable relative to the first unit 1, the positional relationship between the driven shaft 10 and the second impression cylinder 14 can be maintained unchanged when the units and 2 are connected together. As a result, no variation is provided with respect to the sheet delivering mode from the chain gripper 13 to the second impression cylinder 14, Furthermore, no variation occurs with respect to meshing engagement between the gear 56 fixed to the driven shaft 10 of the first printing unit and the gear 57 of the second impression cylinder 14 of the second printing unit. Therefore, regular driving manners to the first and second units are obtainable.

While the invention has been described in detail and with reference to specific embodiment threof, it would be apparent for those skilled in the art that various changes and modifications can be made therein without departing from the spirit and scope of the invention.

What is claimed is:

1. An offset printing machine having two printing units comprising:

a first printing unit comprising a front frame (25), a rear frame (25'), a first impression cylinder (5), and a first chain delivery unit (8) having an endless chain (12) and a driven shaft (10) rotatably supported by the front and rear frames (25 25');

a second printing unit comprising a second front frame (26), a second rear frame (26'), and a second impression cylinder (14);

a tension control means for controlling tension of the endless chain (12), the tension control means comprising a pair of first and second bearing holders (28 29) for supporting the driven shaft (10) and movable relative to the front and rear frames (25 25') in a tension controlling direction; a linking holder (30) provided integral with the first bearing holder (28), and a pivot holder (31) provided integral with the second bearing holder (29);

means for pivoting the second printing unit (2), the pivoting means comprising the pivot holder (31), a first holder (45) fixed to the second rear frame (26'), a pivot bolt (27) supported on the first holder (45) and engageable with the pivot holder (31); and means for connecting the second unit (2) to the first unit (1), the connecting means comprising the linking holder (30), a second holder (42) fixed to the second front frame (26) end a linking pin (44) supported by the second holder (42) and engageable with the linking holder (30).

2. The offset printing machine as claimed in claim 1, wherein the bearing holders (28 29) are formed with thread holes, and wherein the tension control means further comprises blocks (33 34) fixed to the first front and rear frames (25 25'), and threaded bolts (35 36) supported by the blocks and engageable with the thread holes, whereby the bearing holders (28 29) together with the linking holder (30) and the pivot holder (31) are slidable relative to the first front and rear frames (25 25').

3. The offset printing machine as claimed in claim 2, wherein the linking holder (30) and the pivot holder (31) are formed with elongated slots (**30*a*, 31*a*) extending in the tension controlling direction, and the tension control means further comprises screws (37 38) engaged with the first front and rear frames (25 25') and spacers (39 40) disposed over the screws (37 38), the spacers being slidable relative to the elongated slots (30*a* 31*a*) for guide travel of the linking holder (30) and the pivot holder (31**).

4. The offset printing machine as claimed in claim 1, wherein the pivot holder (31) has an upper portion formed with a thread hole (47) extending in vertical direction, and wherein the first holder (45) comprises an automatic centering bearing (46) for rotatably supporting the pivot bolt (27), the pivot bolt (27) being fixedly connected to the thread hole (47) for pivoting the first holder (45) about the pivot bolt (27), whereby the second front and rear frames (26 26') are pivotted about the pivot bolt (27).

5. The offset printing machine as claimed in claim 1, wherein the linking holder (30) has an upper portion formed with hole (41) extending in vertical direction, and wherein the connecting means further comprises a spring (43) disposed within the second holder (42) and over the linking pin (44) whereby the linking pin (44) is biasedly fitted with the hole (41).

6. The offset printing machine as claimed in claim 1, wherein the first bearing holder (28) has horizontally extending portion (28*a*), and wherein the horizontal position fixing means (48) comprises a positioning pin (51) movably supported on the horizontally extending portion (28*a*), the positioning pin (51) being engageable with the second front frame (26) at the horizontal position fixing position.

7. The offset printing machine as claimed in claim 1, further comprising a horizontal position fixing means (48 48′) for fixing a horizontal position of the second printing unit (2) relative to the first printing unit (1), the horizontal position fixing means being disposed between the first and second printing units and detachably coupling the second printing unit (2) to the first printing unit (1).

8. The offset printing machine as claimed in claim 7, further comprising a vertical position fixing means (49 49′) for fixing a vertical position of the second printing unit (2) relative to the first printing unit (1), the vertical position fixing means being disposed between the first and second printing units.

9. The offset printing machine as claimed in claim 7, wherein the second bearing holder (29) has a horizontally extending portion (29*a*), and wherein the horizontal position fixing means (48′) comprises a positioning pin (51′) movably supported on the second rear frame (26′), the positioning pin (51′) being engageable with the horizontally extending portion (29*a*) at the horizontal position fixing position.

10. The offset printing machine as claimed in claim 8, wherein the vertical position fixing means (49 49′) comprises projecting holders (53 53′) extending from the first front and rear frames (25 25′) in horizontal direction, the projecting holders (53 53′) having downwardly slanting faces (53*a* 53*a*′) at their front ends and horizontal faces (53*b* 53*b*′). and wheels (55 55′) rotatably supported on the second front and rear frames (26 26′), the wheels (55 55′) being ridable over the slanting faces and then the horizontal faces for defining the vertically fixed position of the second printing unit (2).

11. The offset printing machine as claimed in claim 1, further comprising a sprocket (11) fixedly mounted on the driven shaft (10), a first gear (56) fixedly connected to the sprocket, and a second gear (57) provided integral with and coaxial with the second impression cylinder (14), the first gear being engageable with the second gear when the second printing unit being connected to the first printing unit.

* * * * *